US008403625B2

(12) United States Patent
Binder et al.

(10) Patent No.: US 8,403,625 B2
(45) Date of Patent: Mar. 26, 2013

(54) PITOT TUBE PUMP

(75) Inventors: Axel Binder, Frankenthal (DE); Christoph Emde, Bad Wildungen (DE); Christoph Keller, Freinsheim (DE); Christoph Jaeger, Gerolsheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 13/300,215

(22) Filed: Nov. 18, 2011

(65) Prior Publication Data

US 2012/0107093 A1 May 3, 2012

Related U.S. Application Data

(63) Continuation of application No. PCT/EP2010/054920, filed on Apr. 15, 2010.

(51) Int. Cl.
*F01D 1/12* (2006.01)

(52) U.S. Cl. ..... 415/88; 417/68

(58) Field of Classification Search ..... 415/63, 415/80, 81, 88, 89, 90, 120; 416/4, 90 A, 416/91; 417/66, 68, 69, 71
See application file for complete search history.

(56) References Cited

U.S. PATENT DOCUMENTS

| | | | | |
|---|---|---|---|---|
| 1,032,892 A | | 7/1912 | Goudard et al. | |
| 4,626,176 A | * | 12/1986 | Cole | 417/54 |
| 4,787,824 A | * | 11/1988 | Cole | 417/54 |
| 4,875,826 A | | 10/1989 | Readman | |
| 5,145,314 A | | 9/1992 | Westhoff, Jr. et al. | |
| 5,261,784 A | * | 11/1993 | Weber | 415/88 |
| 6,817,845 B2 | | 11/2004 | Angle et al. | |
| 2006/0198731 A1 | | 9/2006 | Shaw et al. | |

FOREIGN PATENT DOCUMENTS

| | | | |
|---|---|---|---|
| DE | 139 240 | A | 3/1903 |
| DE | 22 22 055 | A1 | 7/1973 |
| DE | 31 38 315 | A1 | 6/1982 |
| DE | 10 2006 028 597 | A1 | 12/2007 |
| DE | 11 2006 000 496 | T5 | 1/2008 |
| DE | 10 2007 033 644 | A1 | 1/2009 |
| GB | 493 333 | A | 10/1938 |
| WO | WO 8912170 | A1 * | 12/1989 |
| WO | WO 03/089788 | A1 | 10/2003 |

OTHER PUBLICATIONS

Corresponding International Search Report with English Translation dated Sep. 30, 2010 (four (4) pages).
Form PCT/ISA/237 (four (4) pages).
German Office Action dated Feb. 15, 2010 (three (3) pages).
Translation of Form PCT/ISA/237 (four (4) pages).
Corresponding International Preliminary Report on Patentability dated Dec. 8, 2011 ( two (2) pages).

* cited by examiner

*Primary Examiner* — Edward Look
*Assistant Examiner* — Jason Davis
(74) *Attorney, Agent, or Firm* — Crowell & Moring LLP

(57) ABSTRACT

A pitot tube pump having a hydraulic chamber, a fluid supply line, a fluid discharge line, and a drive, in which the supply line, the discharge line and the drive are all arranged on the same side of the hydraulic chamber. A pitot tube preferably is mounted in the hydraulic chamber on a shoulder of a fixed shaft in communication with the discharge line. The drive is preferably an electric motor with a stator which is connected in a rotationally secure manner to the fixed shaft, and a rotor which forms a part of the hydraulic chamber or which is connected in a rotationally secure manner to the hydraulic chamber.

20 Claims, 1 Drawing Sheet

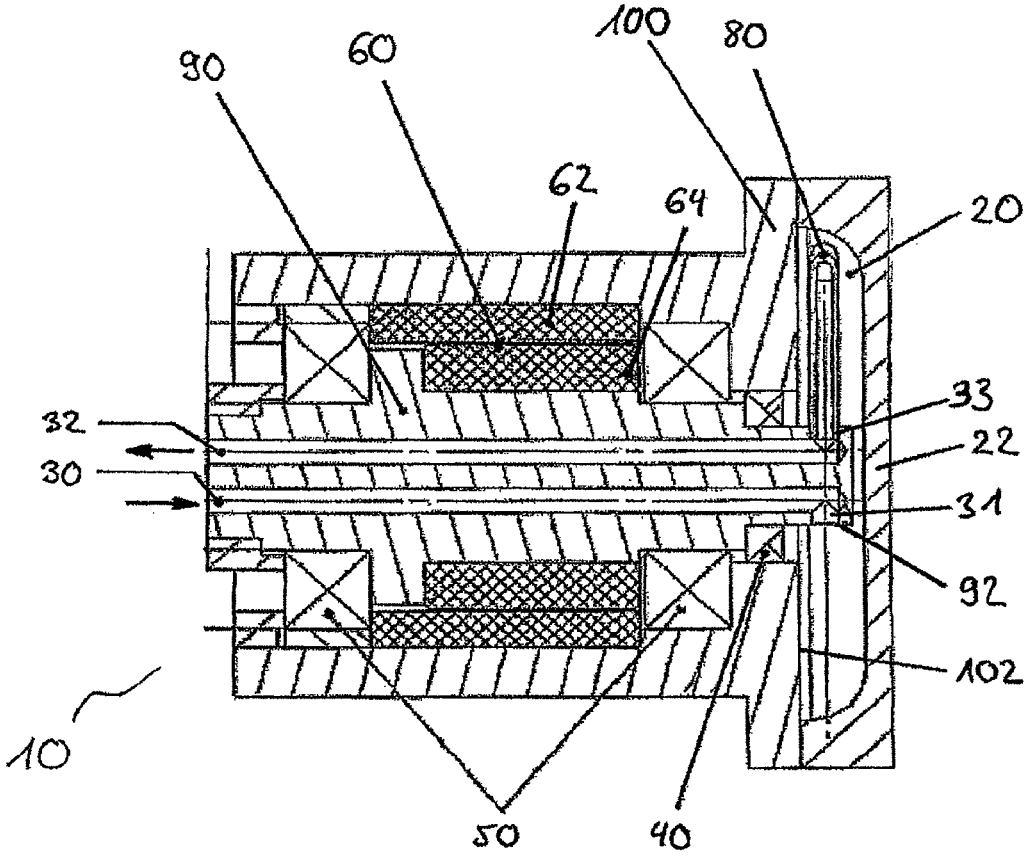
100
80
90
60
62
64
20
33
32
22
30
31
92
102
10
50
40

PITOT TUBE PUMP

CROSS REFERENCE TO RELATED APPLICATIONS

This application is a continuation of international patent application no. PCT/EP2010/054920, filed Apr. 15, 2010, designating the United States of America and published in German on Nov. 25, 2010 as WO 2010/133405, the entire disclosure of which is incorporated herein by reference. Priority is claimed based on Federal Republic of Germany patent application no. DE 10 2009 021 922.6, filed May 19, 2009, the entire disclosure of which is likewise incorporated herein by reference.

BACKGROUND OF THE INVENTION

The present invention relates to a pitot tube pump comprising at least one supply line and at least one discharge line, as well as a hydraulic chamber and a drive. Pitot tube pumps of this type are also known as pitot pumps, jet pumps, turbopumps or pumps comprising a pitot element. Traditional pumps based on the pitot pump principle are driven by means of a bearing bracket and a motor coupled thereto. On the opposite side of the hydraulic chamber are located fluid ports, as well as the lead-through of the pitot tube into the hydraulic chamber, which lead-through is sealed by a dynamic seal. In this case the dynamic seal is oriented toward the hydraulic chamber via a casing which encloses the hydraulic chamber and which is connected to the bearing bracket.

The drawbacks of the described construction derive from production-related misalignments between the support of the hydraulic chamber by means of the bearing bracket and the opposite-situated dynamic seal of the pitot tube, which seal is supported by the casing. In order to be able to ensure the operability of the arrangement, narrow production tolerances and a complex assembly are necessary. Moreover, unavoidable alignment errors give rise to increased wear of the dynamic seal, which in turn, given a lengthy service life, can inevitably lead to leakage or total failure of the seal. Regular maintenance intervals are thus essential in order to be able to exchange the dynamic seal in time. A further drawback is the large spatial requirement of traditional arrangements.

U.S. Pat. No. 4,875,826 discloses a pitot tube pump which has a plurality of pitot elements in an encapsulated pump chamber. The inlet and outlet of the hydraulic chamber in this case are arranged on different sides of the pump.

German published patent application no. DE 10 2007 033 644 A1 discloses a pitot tube pump in which the motor and the inlet and outlet from and to the pump chamber are arranged on different sides of the pump chamber.

German published patent application no. DE 10 2006 028 597 A1 discloses a pitot tube pump in which the motor and the inlet and outlet from and to the pump chamber are arranged on different sides of a pump chamber located within a casing.

U.S. Pat. No. 5,145,314 describes a pitot tube pump, in which the drive and the fluid-conducting line are arranged on different sides of the pump chamber. By contrast, U.S. Pat. No. 1,032,892 shows a pitot tube pump comprising at least one supply line and at least one discharge line, as well as a hydraulic chamber and a drive, with the drive, supply line and discharge line being arranged on a common side of the hydraulic chamber.

US patent publication no. US 2006/198731 (=DE 11 2006 000 496 T5) describes a pitot tube pump comprising a pump chamber, in which a wear ring is inserted in a groove, adjacent the pitot tube within the pump chamber. In this pitot tube pump, the drive and the fluid-conducting lines are arranged on different sides of the pump.

U.S. Pat. No. 6,817,845 (=WO 03/089788) describes a pitot tube pump in which the pump drive and the inlet and outlet from/to the pump chamber are arranged on different sides of a pump chamber which is located within a casing.

SUMMARY OF THE INVENTION

It is an object of the present invention to provide an improved pitot tube pump of the type described above.

Another object of the invention is to provide a pitot tube pump which can be built with a simpler and more durable construction.

A further object of the invention is to provide a pitot tube pump which facilitates simple inspection and maintenance.

It is also an object of the invention to provide a pitot tube pump which has a more compact overall construction.

These and other objects of the invention have been achieved by providing a pitot tube pump as described and claimed hereinafter.

In accordance with the invention, the supply line and/or the discharge line (30, 32) is arranged in the fixed shaft (90), in particular the supply and the discharge line (30, 32) are arranged only in the shaft (90), and the electric motor has at least one stator (64) and at least one rotor (62), with the stator (64) being is connected in a rotationally secure manner to the shaft (90), and/or with the rotor (62) being a constituent part of the hydraulic chamber (20), and/or with the rotor (62) being connected in a rotationally secure manner to the hydraulic chamber (20).

The drive, supply line and discharge line are here arranged on a common side of the hydraulic chamber. The sides of the hydraulic chamber can be constituted by the broad sides of the hydraulic chamber.

Usually, at least one pitot tube is arranged in the hydraulic chamber. This pitot tube is preferably fixedly arranged, the hydraulic chamber and components of the hydraulic chamber rotating relatively about the pitot tube in order to radially accelerate the fluid to be pumped.

It is advantageous if the supply line and/or the discharge line are arranged in the fixed shaft, in particular if the supply line and the discharge line are arranged only in the shaft.

The supply line and/or the discharge line can preferably be formed by axial bores along the longitudinal axis of the shaft. Advantageously, this/these axial bore(s) is/are connected to the port or ports located in a shoulder or protrusion, which ports are preferably constructed as radial bores. The radial bore arranged in the protrusion of the shaft can, for example, meet at right angles with the axial bore of the supply line or discharge line, which axial bore does not extend through the protrusion, so that the radial bore can serve as an inlet to or outlet from the hydraulic chamber.

It is also advantageous for the electric motor to have at least one stator and at least one rotor, wherein the stator is connected in a rotationally secure manner to the shaft, and/or the rotor is a constituent part of the hydraulic chamber, and/or the rotor is connected in a rotationally secure manner to the hydraulic chamber. The stator can in this case, for instance, likewise be a constituent part of the shaft. However, the stator can also be positively and/or non-positively connected in a rotationally secure manner to the shaft, for example by a press fit or by a keyway/feather key connection.

Advantageously, the rotor can, for instance, be constructed so that it forms a wall or wall structure of the hydraulic chamber. It is likewise equally possible for the rotor to be positively and/or non-positively connected in a rotationally secure manner to the hydraulic chamber, for example by a press fit or by a keyway/feather key connection. In this case, it is also conceivable for the connection to the hydraulic chamber to be realized directly and/or indirectly. It can be sufficient, for instance, if the rotor is fastened to a structural part that is connected to an element which forms a wall of the hydraulic chamber, or if the rotor itself is an element which forms a wall of the hydraulic chamber.

The arrangement according to the invention gives the advantage that the pitot tube pump can be very compactly constructed. For instance, a mounting to both sides of the hydraulic chamber can be dispensed with. The arrangement of the essential components of the pitot tube pump on a common side of the hydraulic chamber provides improved accessibility to the hydraulic chamber. Inspection and maintenance are thereby simplified. Advantageously, no separate casing for the hydraulic chamber and the other components of the pitot tube pump needs to be provided.

It is also conceivable for at least one bearing, preferably the mounting for the moving components of the pitot tube pump, to be arranged on the common side. In particular, this gives the advantage that all moving and also non-moving components of the pitot tube pump are arranged on one side only of the hydraulic chamber, so that the hydraulic chamber is basically freely accessible via the free remaining side. As a result, inspection and maintenance are made significantly easier.

The pitot tube pump may be provided with a fixed shaft. A fixed shaft of this type may be a central shaft about which the moving components of the pitot tube pump rotate.

It is also possible for the fixed shaft to have a shoulder or protrusion which projects into the hydraulic chamber, whereby the supply line and discharge line open or have their connections in this protrusion. For instance, the connections to the supply and discharge lines can be realized by radial bores in the protrusion.

In addition, at least one pitot tube may be provided, which is arranged on the protrusion. The pitot tube is preferably connected to the port of the discharge line located on the protrusion.

The drive may be an electric motor. A particularly advantageous type of drive can thereby be utilized. The control or regulation of the pitot tube pump can thereby be simply and advantageously designed. To this end, a conventional actuator or a conventional control and/or regulating unit can be used to control the motor.

It is also possible for a dynamic seal to be provided, which dynamic seal seals a gap between the moving and non-moving components of the pitot tube pump. Preferably, the dynamic seal seals the gap between a fixed shaft and a moving rotor bracket. In this context, the term "dynamic seal" should be viewed as an expansive term, which can embrace, for instance, one or more radial shaft sealing rings. Furthermore, a constituent part of a dynamic seal can be a sealing labyrinth functionally linked to the dynamic seal. In principle, it may be sufficient, however, if the dynamic seal is formed by a radial shaft sealing ring. The rotor bracket can, for instance, be a structural part which is rotatable about the fixed shaft of the pitot tube pump and which is preferably connected to the rotating hydraulic chamber. The rotor bracket may be a constituent part of the hydraulic chamber itself, or it may be connected to the hydraulic chamber in a rotationally secure manner. In this context, it can advantageously be provided that the rotor bracket forms a wall of the hydraulic chamber or is formed by a wall of the hydraulic chamber.

It can further be provided that a single dynamic seal is provided, and/or that the dynamic seal is seated and/or runs on the fixed shaft or on the protrusion of the shaft. The pitot tube pump preferably has just a single gap to be sealed between the fixed shaft and the rotor bracket. The resulting advantage is that it is only necessary to provide a dynamic seal at this one location. Preferably, a radial shaft sealing ring is inserted such that the sealing lip is connected in a rotationally secure manner to the rotor bracket or to that structural part of the pitot tube pump which rotates about the shaft and revolves around the protrusion of the fixed shaft. It is hence sufficient, for instance, to harden only the protrusion, whereby the service life of the dynamic seal can be increased. At the same time, the protrusion can be hardened in a comparatively simple and cost-effective manner.

The hydraulic chamber may be provided with a removable cover. This gives the advantage that the hydraulic chamber is easily accessible. An inspection or maintenance operation, for instance, can thus be carried out rapidly and without difficulty.

In addition, it is conceivable that the cover substantially encloses or forms the hydraulic chamber, and/or that the cover is fastened to a wall of the moving components of the pitot tube pump, preferably to the rotor bracket.

It is also possible for the cover to overlap the pitot tube. This gives the advantage that during inspection or maintenance, the state of the pitot tube can be easily checked. In addition, the pitot tube, if necessary, can be easily cleaned or exchanged, since, due to the overlapping cover, it is freely accessible when the cover is removed.

It is preferred if the cover is arranged on that side of the hydraulic chamber which lies opposite the common side. Simple removal of the cover is thereby facilitated.

It is particularly advantageous if, following disassembly of the cover, the hydraulic chamber and/or the pitot tube is accessible, and/or if the rotor bracket becomes accessible such that it can be pulled off the fixed shaft.

BRIEF DESCRIPTION OF THE DRAWING

The invention will be described in further detail hereinafter with reference to an illustrative embodiment shown in the accompanying drawing FIGURE which is a sectional view through a pitot tube pump constructed according to the invention.

DETAILED DESCRIPTION OF PREFERRED EMBODIMENTS

The accompanying drawing FIGURE shows a sectional drawing through a pitot tube pump 10 according to the invention. In this pitot tube pump 10, the fluid ports 30 and 32, i.e. the supply line 30 and the discharge line 32, are arranged on that side of the hydraulic chamber 20 which is shown on the left in the FIGURE. Moreover, in this part of the pitot tube pump 10 or on this left side are also found the dynamic seal 40 and also the mounting bearings 50 and the drive 60.

The mounting bearings 50 and the drive 60 are constructed as an integrated bearing and drive unit 70, i.e. the mounting bearings 50 assume both the function of the mounting for the rotating hydraulic chamber 20 and of the mounting for the drive 60. This gives the advantage of substantially smaller spatial requirement and considerable cost benefits, since a number of previously vital components, such as a clutch and a bearing bracket, are no longer necessary according to the invention.

The fixed pitot tube 80 is inserted in the rotating hydraulic chamber 20 and is sealed by a dynamic seal 40. The pitot tube 80 is here mounted on a radial shoulder or protrusion 92 of the fixed shaft 90 and is connected to a radial bore 33 arranged in the protrusion 92. This radial bore 33 in this case is connected to the discharge line 32. The supply line 30 is also connected to a radial bore 31 arranged in the protrusion 92 such that the radial bore 32 enables the supplied fluid to flow into the hydraulic chamber 20. The radial bores 31 and 33 are respectively positioned perpendicular to their associated axial supply and discharge lines formed by axial bores 30 and 32.

The drive 60 is constructed as an external rotor motor and is located on the same side of the hydraulic chamber 20 as the fluid ports 30 and 32. The rotor 62 of the drive 60 is preferably already a constituent part of the hydraulic chamber 20 or, as represented in the drawing FIGURE, is coupled directly or in a rotationally secure manner to the hydraulic chamber 20, so that an additional clutch can be dispensed with. The stator 64 of the drive 60 is rotationally secure on the fixed shaft 90 of the pitot tube pump 10.

In the illustrative embodiment represented in the drawing FIGURE, the rotor 62 is fastened in a rotationally secure manner to a rotor bracket 100. In this case a flange-like wall 102 of the rotor bracket 100 forms a wall of the hydraulic chamber 20. In addition, the cover 22 of the hydraulic chamber 20 is fastened to this flange-like wall 102 of the rotor bracket 100. The actual interior of the hydraulic chamber 20 is formed by a cutout or recess in the cover 22. The cover 22 overlaps both the protrusion 92 and the pitot tube 80, so that, when the cover 22 is removed, the components located in the hydraulic chamber 20 are freely accessible.

Of particular importance in the represented illustrative embodiment is that the single gap to be sealed between the moving and non-moving parts of the pitot tube pump 10 is the gap between the protrusion 92 of the fixed shaft 90 and the rotor bracket 100. For this purpose, a dynamic seal 40, constructed for example as a pressure-resistant radial shaft sealing ring, is inserted in this gap. The sealing lip of this radial shaft sealing ring can bear, for example, against the hardened protrusion 92.

In the fixed shaft 90 of the pitot tube pump 10, the fluid to be pumped is supplied to the hydraulic chamber 20 via the supply line 30 arranged in the shaft 90 and, following entry into the fixed pitot tube 80, which is connected on the end side to discharge line 32, is conducted away via the discharge line 32, which likewise is arranged in the shaft 90.

In principle, it is conceivable that a supply and discharge line (not shown in detail) can be provided in the fixed shaft 90 for a cooling medium by which the drive 60 and/or the hydraulic chamber 20 can be cooled.

The tolerance chain between the mounting 50 and the installation space of the dynamic seal 40, which tolerance chain is severely abbreviated due to the inventive arrangement, enables a simpler and more cost-effective production to be achieved. Furthermore, a reliable operation combined with an extended service life is possible, in particular due to the less heavily stressed dynamic seal 40.

By virtue of the overall arrangement of the components of the pitot tube pump 10, simple installation is possible. The maintenance of the hydraulic chamber 20 and of the pitot tube 80 is made significantly easier. Following removal of the cover 22 of the hydraulic chamber 20, both the hydraulic chamber 20 and the pitot tube 80 are freely accessible.

Following disassembly of the pitot tube 80, a full servicing of the drive 60 and of the mounting 50 can be carried out by pulling the rotor 62 off from the stator 64 or from the shaft 90. The installation or assembly of the pitot tube pump 10 can then be effected, following inspection or maintenance, in reverse order from the disassembly.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A pitot tube pump comprising a hydraulic chamber, a supply line, a discharge line, and a drive, wherein:

the supply line, the discharge line and the drive are all arranged on the same side of the hydraulic chamber;

the supply line and the discharge line are arranged in a fixed shaft;

the drive is an electric motor having a stator and a rotor;

the stator is connected in a rotationally secure manner to the fixed shaft, and the rotor forms a constituent part of the hydraulic chamber or is connected in a rotationally secure manner to the hydraulic chamber.

2. The pitot tube pump as claimed in claim 1, wherein at least one bearing is arranged between the fixed shaft and the hydraulic chamber on the same side of the hydraulic chamber as the supply line, discharge line and drive.

3. The pitot tube pump as claimed in claim 2, wherein said at least one bearing serves as the mounting for all moving parts of the pitot tube pump.

4. The pitot tube pump as claimed in claim 1, wherein the fixed shaft has a protrusion which projects into the hydraulic chamber.

5. The pitot tube pump as claimed in claim 4, wherein at least one of the supply line and the discharge line opens in to the hydraulic chamber through a port formed in the protrusion.

6. The pitot tube pump as claimed in claim 5, further comprising at least one pitot tube provided in the hydraulic chamber arranged on the protrusion.

7. The pitot tube pump as claimed in claim 6, wherein the hydraulic chamber has a removable cover which overlaps the pitot tube.

8. The pitot tube pump as claimed in claim 7, wherein the cover is arranged on the side of the hydraulic chamber which lies opposite the side on which the supply line, the discharge line and the drive are arranged.

9. The pitot tube pump as claimed in claim 8, wherein following removal of the cover, the hydraulic chamber and the pitot tube are accessible.

10. The pitot tube pump as claimed in claim 1, further comprising a dynamic seal for sealing a gap between moving and non-moving components of the pitot tube pump.

11. The pitot tube pump as claimed in claim 10, wherein the dynamic seal seals a gap between the fixed shaft and a moving rotor bracket.

12. The pitot tube pump as claimed in claim 11, wherein a single dynamic seal is provided.

13. The pitot tube pump as claimed in claim 12, wherein the dynamic seal is mounted on the rotor bracket and bears against the fixed shaft.

14. The pitot tube pump as claimed in claim 13, wherein the dynamic seal bears against a protrusion on the fixed shaft.

15. The pitot tube pump as claimed in claim 1, wherein the hydraulic chamber has a removable cover.

16. The pitot tube pump as claimed in claim 15, wherein the cover substantially encloses the hydraulic chamber.

17. The pitot tube pump as claimed in claim 15, wherein the hydraulic chamber is formed by a recess in the removable cover.

18. The pitot tube pump as claimed in claim 15, wherein the cover is fastened to a wall of a moving component of the pitot tube pump.

19. The pitot tube pump as claimed in claim 18, wherein the cover is fastened to a moving rotor bracket.

20. The pitot tube pump as claimed in claim 15, wherein following removal of the cover, the rotor becomes accessible such that it can be pulled off the fixed shaft.

* * * * *